United States Patent [19]

Berghahn et al.

[11] 4,298,125

[45] Nov. 3, 1981

[54] DIAL TYPE CHILD RESISTANT DISPENSER

[75] Inventors: Walter G. Berghahn, Scotch Plains; Jack Weinstein, Old Bridge, both of N.J.

[73] Assignee: Bristol-Myers Company, New York, N.Y.

[21] Appl. No.: 151,062

[22] Filed: May 19, 1980

[51] Int. Cl.[3] ..... B65D 83/04; G09F 9/40

[52] U.S. Cl. ..... 206/531; 206/534; 206/532; 116/308

[58] Field of Search ..... 206/531, 532, 533, 534, 206/536; 116/308, 309, 327, 328, 329

[56] References Cited

U.S. PATENT DOCUMENTS

| | | | |
|---|---|---|---|
| 975,681 | 11/1910 | Ernsberger | 206/533 |
| 2,971,638 | 2/1961 | Allison et al. | 206/532 |
| 3,054,503 | 9/1962 | Hartman, Jr. et al. | 206/531 |
| 3,199,489 | 8/1965 | Ruoss et al. | 206/531 X |
| 3,276,573 | 10/1966 | Kaufman et al. | 206/531 |
| 3,279,651 | 10/1966 | Thompson | 206/531 |
| 3,303,927 | 2/1967 | Ballard | 206/533 |
| 3,904,075 | 9/1975 | Richardson et al. | 206/531 X |
| 3,905,479 | 9/1975 | Gerner et al. | 206/531 |
| 3,912,081 | 10/1975 | Haines et al. | 206/531 |
| 3,912,082 | 10/1975 | Gerner et al. | 206/531 |
| 3,924,747 | 12/1975 | Gerner | 206/531 |
| 4,015,717 | 4/1977 | Richardson et al. | 206/534 |
| 4,074,806 | 2/1978 | Ardito | 206/531 |
| 4,120,400 | 10/1978 | Kotyuk | 206/528 |
| 4,164,301 | 8/1979 | Thayer | 206/534 X |
| 4,165,709 | 8/1979 | Studer | 116/308 |

*Primary Examiner*—Steven M. Pollard

*Attorney, Agent, or Firm*—Irving Holtzman; George A. Mentis

[57] ABSTRACT

A child resistant dispensing package for tablets and the like of the dial type provided with a dispenser opening in the upper section; the lower section is provided with a plurality of flexible tablet pockets that are covered over with a sheet of rupturable material (e.g. aluminum foil); the upper and lower sections are provided with location indicators to line the tablet pockets up with the dispenser opening; tablets are dispensed by pushing the tablet pockets with enough force to rupture the sheet material.

6 Claims, 5 Drawing Figures

DIAL TYPE CHILD RESISTANT DISPENSER

This invention relates to a child resistant dispensing package. More particularly, it concerns a child resistant package of the so-called dial type designed to dispense tablets, capsules, and similar unit dosage forms which is portable, convenient and has the requisite moisture seal.

Portable dispensing packages for tablets, capsules and the like serve an important function. It is often necessary or desirable to take medication when one is away from home. Typical medicinal packages that are designed for home use and storage in a medicine cabinet are not conveniently carried about. Although numerous child resistant packages have been suggested for medicinal packages intended to be stored in a medicine cabinet or the like, these are not suitable for use away from home.

A number of dial type dispensing packages for medication have also been suggested in the prior art. By way of illustration, mention may be made of U.S. Pat. Nos. 3,303,927; 3,199,489; 3,276,573 and 3,279,651. These packages, however, are not suitable as a child resistant package.

It is accordingly an object of the present invention to provide a dial type package dispenser for tablets, capsules and the like which has child resistant features.

Other and more detailed objects of this invention will be apparent from the following description, drawings and claims.

FIG. 1 of the attached drawings is a perspective view of the child resistant safety package of the present invention as seen from above;

Figure 1:
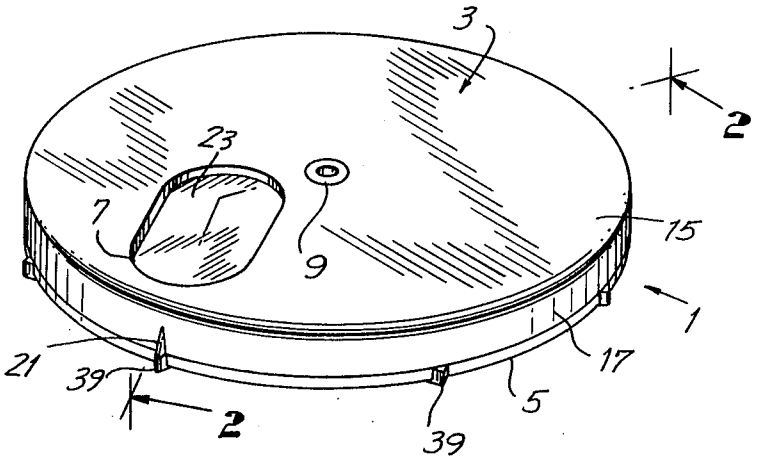

Referring to FIG. 1 the dispenser is shown generally at 1 and comprises an upper section 3 and a base 5. Upper section 3 is provided with a dispenser opening 7 through which the tablets or capsules may be dispensed. A centrally disposed cylindrical bearing 9 is bored through the center of upper section 3. An annular bead 11 projecting inwardly is provided near the lower margin of bearing 9. This mates with a corresponding groove provided in the center post 13 of base 5 in a manner described in more detail below. Upper section 3 comprises a roof 15 and a depending skirt 17. An annular bead 19 is also provided near the lower margin of the inner surface of skirt 17. This also mates with a corresponding groove 18 provided in the outer wall of base 5 as described in more detail below.

A triangular position indicator 21 is provided which extends outwardly from skirt 17 and downwardly to the lower margin of said skirt 17. Indicator 21 is so disposed that its plane, if projected through the top of upper section 3 would cut dispenser opening 7 in half longitudinally.

Upper section 3 may be made of any suitable rigid or semi-rigid opaque material. However, this will usually be molded of a plastic material; the preferred plastic being high impact styrene, or polypropylene.

Figure 2:
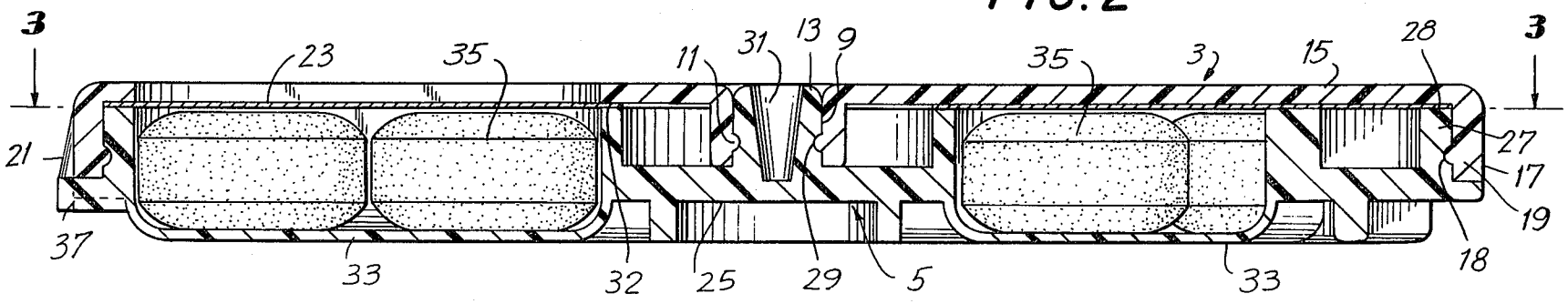
FIG. 2 is a cross sectional view of the device shown in FIG. 1 taken along line 2—2.
Figure 4:
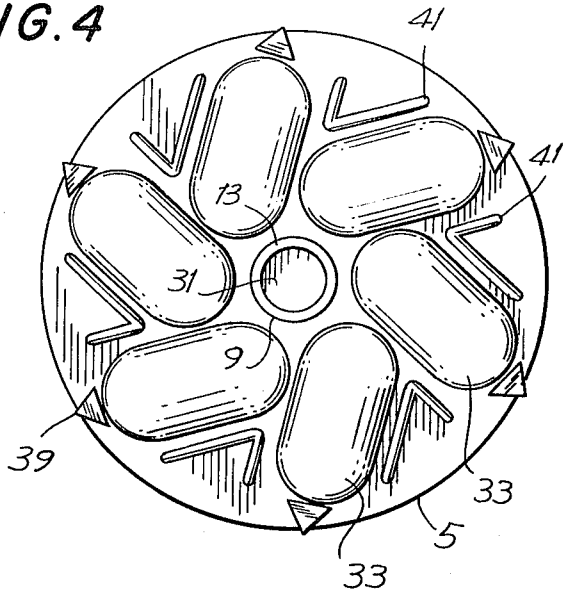
FIG. 4 is a bottom plan view of the device shown in FIG. 1.
Figure 3:
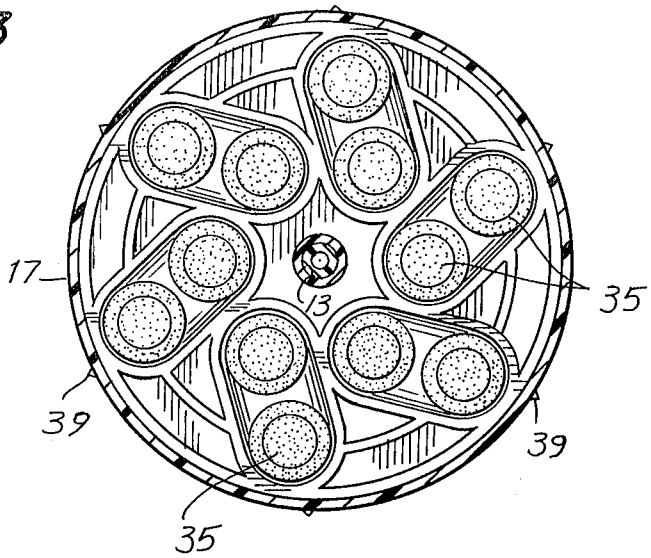
FIG. 3 is a horizontal sectional view of FIG. 2 taken along lines 3—3 of FIG. 2.

Base 5 is also constructed so as to comprise a floor 25 and an upwardly extending skirt 27. As indicated above, base 5 is provided with a centrally disposed post 13 that extends upwardly and mates with bearing 9. An annular groove 29 provided near the base of post 13 mates with bead 11 when the upper and lower sections are assembled. For the convenience in casting, post 13 is shown as being provided with a well 31 which is bored through the greater portion of the depth of post 13. Extending downwardly from floor 5 are a plurality of tablet pockets 33, as best seen in FIGS. 2 and 3. Disposed within each of these pockets are a pair of tablets 35 best seen in FIG. 3. Although the modification of the invention illustrated is shown as being useful in dispensing tablets, other product forms such as capsules, spherules and the like may be employed.

Extending outwardly from skirt 27 near its lower margin is annular flange 37. This serves as a bearing surface for upper section 3 and engages the marginal rim of upper section 3 when the parts of the package are assembled. Position indicators 39 are also provided in base 5 associated with each of the tablet pockets 33. A plurality of gripping means 41 are also provided which will assist in turning base 5 with respect to upper section 3.

Tablet pockets 33 are made of a flexible material which permits their deformation. This material could also be opaque so that the tablets may not be seen. Tablet pockets 33 may be made from the same or a different material from base 5. However, in a preferred form of this invention, base 5 including pockets 33 is molded as a unit from a suitable flexible plastic material. The preferred material employed is low density polyethylene.

Sealed to the upper surface of base 5 and spanning the openings of tablet pockets 33 there is provided a sheet of opaque material 23 which may be broken by the application of pressure thereto. Although a variety of materials may be employed, it has been found that aluminum foil having a gauge of from 0.0003" to 0.0010" is most suitable. This is preferably sealed to the upper margin 28 of skirt 27 as well as around the upper margins 32 of each of the tablet pockets 33. This sealing may be accomplished by any of the techniques well known to those skilled in this art e.g. heat sealing, induction heating, etc.

In use, tablets 35 are loaded into pockets 33 as shown in FIG. 3 and sheet material 23 is sealed to the upper surface of base 5. Upper section 3 is then positioned on base 5 so that center post 13 is inserted into bearing 9. The upper section 3 and base 5 are then pressed home so that annular bead 11 engages annular groove 29 and annular bead 19 engages annular groove 18.

Figure 5:
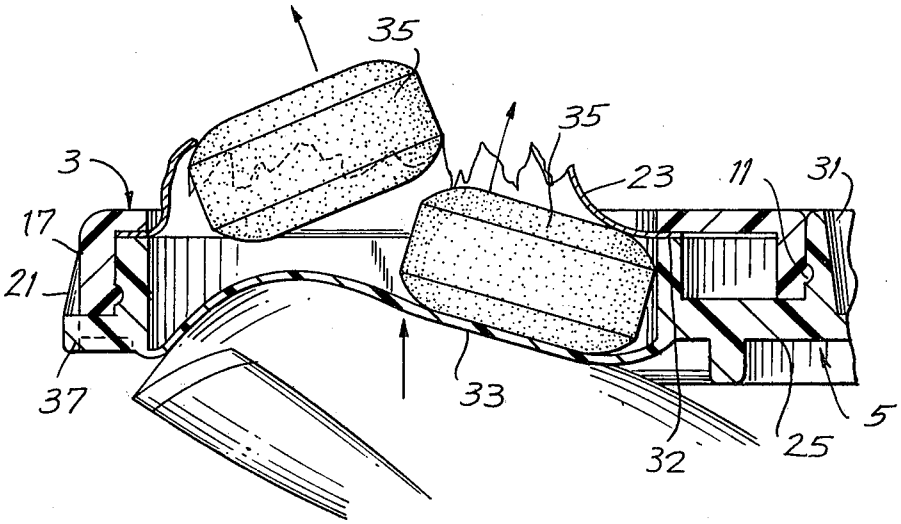
FIG. 5 is a partial sectional view similar to that shown in FIG. 2 showing the manner of dispensing the tablets from the present dispensing package.

Upper section 3 is rotatable around central post 13. To assist in this rotation, gripping means 41 can be engaged by the nail on the hand. To dispense the tablets, the position indicator 21 on upper section 3 is rotated until it is lined up with one of the position indicators 39 on the base. Pressure is then applied to the lower flexible surface of tablet pocket 33 that is lined up with dispenser opening 7. Enough pressure is then applied with the finger as shown in FIG. 5 to rupture the aluminum foil 23 that covers the dispenser opening 7 and the tablets are dispensed.

The features of this construction that aid to the child resistant character of this dispenser are several. In the first place, all of the elements are opaque so that the child cannot see the tablets. Secondly, it takes a certain amount of dexterity and knowledge to be able to line the position indicators up properly so that the tablets can be dispensed. This is generally more than is expected of a child in the age range of from 42 to 51 months. Furthermore, since only two tablets can be dispensed at a time, the danger that the child might be able to take enough tablets to be lethal is greatly reduced.

In addition, the tablets contained in the tablet pockets are sealed from the atmosphere. This is an important feature, particularly in the cases in which the tablets contained in the pockets are sensitive to atmospheric moisture and the like.

The child resistant unit package of this invention was evaluated for its child resistant effectiveness in accordance with the Consumer Product Safety Commission protocol cited in C.F.R. Title 16, Section 1700. A total of 200 children, ages 42 to 51 months, and 100 adults (70 females and 30 males), ages 18 to 45 years, was evaluated.

Results of this evaluation demonstrated that this unit type package is effective in preventing child entry evidenced by unsuccessful opening percentages of 100 before demonstration and 97 after demonstration.

In addition, this same unit presented to 100 adults (70 females and 30 males) demonstrated adult opening effectiveness and acceptance evidenced by a successful opening percentage of 100 for opening the closure in an average time of 32.1 seconds.

Based on these results, this package can be designated as a child resistant (or safety) package in accordance with C.P.S.C. requirements and standards cited in C.F.R. Title 16, Section 1700.

The testing procedures cited in the U.S. Consumer Product Safety Commission protocol for the evaluation of child resistant effectiveness, C.F.R. Title 16, Section 1700, were followed throughout this evaluation.

PROTOCOL

A panel of 200 children between the ages of 42 and 51 months, inclusive, was used to evaluate the ability of the package in the attached drawings and described in the present specification to resist opening by children. The sex of the children in each of the required ten age groups was evenly divided between male and female, showing no more than a ten percent preponderance of either sex in each age group. To obtain this distribution, a total of 240 children was evaluated. The children selected were healthy, normal and exhibited no obvious or overt physical or mental handicaps. They were tested in pairs, and the testing was conducted in a location familiar to them. These locations were found in nursery schools, day care centers and church schools. Geographical locations were Essex, Union and Bergen counties in New Jersey, and Rockland county, New York.

The adult panel consisted of 100 adults ranging in age from 18 to 45 years. Seventy of these adults were females and thirty males.

The unit evaluated was the package described herein with a white polystyrene cap over a white polyethylene container.

Directions on the label read:

To Open: "Twist cover to align arrows. Push tablets through foil from rear."

The records obtained relating to successful and unsuccessful openings were assembled in a meaningful manner to determine whether the unit met the recommended and required child resistant standards as cited by the C.P.S.C. standards.

RESULTS AND DISCUSSION

The results of this evaluation appear in Tables 1, 2 and 3 below. These Tables reflect a compilation of all data during the evaluation period.

For purposes of amplification, the following will be discussed:

Unsuccessful openings by the 200 children
Successful openings by 100 adults
Fulfilling C.P.S.C. standards for child resistant packaging

UNSUCCESSFUL OPENINGS BY CHILDREN

Table 1 indicates that none of the children tested was able to remove more than eight tablets before demonstration, and a total of six removed more than eight tablets after demonstration. These numbers further indicate unsuccessful effectiveness percentages of 100 before demonstration and 97 after demonstration.

The number of successful openings (more than eight tablets removed) according to age and method used in successful entry (teeth or fingers) is presented in Table 2 of this evaluation. It is interesting to note that in this evaluation, and in the vast majority of other closure evaluations conducted by Applicants' assignee, that most successful openings occur in the upper age ranges of 46 to 51 months.

SUCCESSFUL OPENINGS BY ADULTS

The adult panel consisted of 70 females and 30 males, 18 to 45 years of age. Results of the adult successful opening evaluation appear in Table 3. From this, it can be seen that adults were successful in opening the unit and removing two tablets. One hundred adults were successful in opening the unit in an average time of 32.1 seconds.

For additional information, each adult was asked to remove a second dosage (two tablets). Results showed an average successful opening time in this instance to be less than 10 seconds.

MEETING SAFETY CLOSURE STANDARDS

The unit package evaluated fulfilled C.P.S.C. standards for child resistant packaging cited in C.F.R. Title 16, Section 1700 which stipulates:

"Child resistance effectiveness not less than 85% without demonstration and not less than 80% after demonstration . . . " and "Adult use effectiveness not less than 90%."

Child resistant effectiveness for this unit was 100% before demonstration and 97% after demonstration for 200 children, and adult use effectiveness of 100%.

The present unit package exceeds the standards set forth.

TABLE 1

Unit opening evaluation with the present unit package presented to 200 children, 42 to 51 months, tested in pairs.

| Age Months | Total | Male | Female | Successful Openings: Before Demonstration | Successful Openings: After Demonstration |
|---|---|---|---|---|---|
| 42 | 20 | 11 | 9 | 0 | 0 |
| 43 | 20 | 10 | 10 | 0 | 0 |
| 44 | 20 | 11 | 9 | 0 | 0 |
| 45 | 20 | 10 | 10 | 0 | 1 |
| 46 | 20 | 9 | 11 | 0 | 1 |

TABLE 1-continued

Unit opening evaluation with the present unit package presented to 200 children, 42 to 51 months, tested in pairs.

| Age Months | Total | Male | Female | Successful Openings: Before Demonstration | Successful Openings: After Demonstration |
|---|---|---|---|---|---|
| 47 | 20 | 10 | 10 | 0 | 1 |
| 48 | 20 | 9 | 11 | 0 | 1 |
| 49 | 20 | 10 | 10 | 0 | 1 |
| 50 | 20 | 10 | 10 | 0 | 0 |
| 51 | 20 | 10 | 10 | 0 | 1 |
| TOTAL | 200 | 100 | 100 | 0 | 6 |
| Unsuccessful Effectiveness Percent | | | | 100 | 97 |

TABLE 2

Unit opening evaluation with the present unit package presented to 200 children indicating methods of opening package and removing tablets - fingers (F) and teeth (T).

| Age Months | Total | Before Demonstration: Male | Before Demonstration: Female | After Demonstration: Male | After Demonstration: Female |
|---|---|---|---|---|---|
| 42 | 20 | 0 | 0 | 0 | 0 |
| 43 | 20 | 0 | 0 | 0 | 0 |
| 44 | 20 | 0 | 0 | 0 | 0 |
| 45 | 20 | 0 | 0 | 0 | 1 (F) |
| 46 | 20 | 0 | 0 | 0 | 1 (F) |
| 47 | 20 | 0 | 0 | 1 (F) | 0 |
| 48 | 20 | 0 | 0 | 0 | 1 (F) |
| 49 | 20 | 0 | 0 | 1 (F) | 0 |
| 50 | 20 | 0 | 0 | 0 | 0 |
| 51 | 20 | 0 | 0 | 1 (F) | 0 |
| TOTAL | 200 | 0 | 0 | 3 | 3 |

TABLE 3

Unit opening evaluation of the present unit package presented to 100 adults for opening.

| Total | | Successful Without Demonstration |
|---|---|---|
| Females | 70 | 70 |
| Males | 30 | 30 |

Successful Effectiveness Percent: 100
Average Time: 32.1 seconds

ADULT USAGE EFFICIENCY TEST

Observations while testing the children with this unit clearly indicated that once two (2) tablets were removed, leaving the empty two-tablet cavity, most children were stymied in their attempts to determine how to turn the dial in order to expose additional foil-covered tablets. In the coordinator's opinion, an automatic "safe" position would be created when the adult used two tablets and left the empty cavity exposed. This, plus the double motor-physical action of aligning the arrows tends to indicate that an adult usage efficiency evaluation is not required for this unit.

Although the invention has been described with reference to specific forms thereof, it will be understood that many changes and modifications may be made without departing from the spirit of this invention.

What is claimed is:

1. An opaque child resistant dispensing package for tablets and the like comprising:

(a) first and second sections, said sections being adapted to be rotated with respect to each other about a common axis;

(b) a first end wall in said first section, a dispensing opening cut through said first end wall and first position indicator means associated with said dispensing opening to assist in positioning said opening for dispensing said tablets;

(c) a second end wall in said second section, a plurality of flexible open-ended pockets adapted to hold tablets and the like depending from said second end wall; each of said flexible pockets having associated therewith a second position indicating means; and (d) rupturable opaque sheet material secured to said second end wall and spanning the open ends of said pockets;

said dispensing package being adapted to rotate said sections to bring said first and second position indicator means into registration with each other whereby pressure may be applied to said pocket to push said tablets through said opaque sheet material.

2. A dispensing package according to claim 1 in which said sheet material is aluminum foil.

3. A dispensing package according to claim 2 in which said aluminum foil has a gauge within the range of from 0.003" to 0.0010".

4. A dispensing package according to claim 2 in which each of said first and second section is molded as a unitary piece.

5. A dispensing package according to claim 2 in which said second section is molded as a unitary piece from low density polyethylene.

6. A dispensing package according to claim 2 in which said aluminum foil forms a hermetic seal around the margins of each of said pockets.

* * * * *